US010526781B2

(12) United States Patent
Lestini et al.

(10) Patent No.: US 10,526,781 B2
(45) Date of Patent: Jan. 7, 2020

(54) MODULAR BUILDING STRUCTURE WITH INTEGRATED PLANTS

(71) Applicant: EMMEALLAENNE S.R.L., Rome (IT)

(72) Inventors: Federico Lestini, Rome (IT); Luca Pofi, Rome (IT)

(73) Assignee: EMMEALLAENNE S.R.L., Rome (IT)

( * ) Notice: Subject to any disclaimer, the term of this patent is extended or adjusted under 35 U.S.C. 154(b) by 0 days.

(21) Appl. No.: 16/068,780

(22) PCT Filed: Dec. 23, 2016

(86) PCT No.: PCT/IB2016/057972

§ 371 (c)(1),
(2) Date: Jul. 9, 2018

(87) PCT Pub. No.: WO2017/122072

PCT Pub. Date: Jul. 20, 2017

(65) Prior Publication Data

US 2019/0024365 A1 Jan. 24, 2019

(30) Foreign Application Priority Data

Jan. 13, 2016 (IT) ..... 10201602481

(51) Int. Cl.
*E04H 1/00* (2006.01)
*E04B 1/348* (2006.01)
(Continued)

(52) U.S. Cl.
CPC ..... *E04B 1/3483* (2013.01); *E04B 1/1912* (2013.01); *E04B 1/34861* (2013.01);
(Continued)

(58) Field of Classification Search
CPC .. E04B 1/3483; E04B 1/1912; E04B 1/34861; E04B 2001/1984; E04B 2001/1915; E04B 2001/1993; E04F 17/08
(Continued)

(56) References Cited

U.S. PATENT DOCUMENTS 1,867,226 A * 7/1932 Martin ..... B62D 21/00 403/262
2,936,530 A * 5/1960 Bowen ..... G09B 25/04 403/171
(Continued)

FOREIGN PATENT DOCUMENTS

JP H09 328818 A 12/1997
JP 2009209551 A 9/2009
JP 2009228369 A 10/2009

*Primary Examiner* — Basil S Katcheves
(74) *Attorney, Agent, or Firm* — Volpe and Koenig, P.C.

(57) ABSTRACT

A modular building structure with relative integrated plants, as obtained by assembling a plurality of module frames to obtain a complex frame, allows associating ducts of one or more plants to the module frame. The module frames have a parallelepiped-like shape and are identified by beams joining in respective angles, including a plurality of connecting knots joining module frames adjacent to the angles; the adjacent beams of side-by-side module frames are spaced apart by the knots and the panels and are connected to the beams of the module frame thereto, so as to create an air gap. The integrated plants have a plurality of ducts arranged in the air gaps and in the through channels, which include, at edges or angles of the module frame, quick connections for connecting the ducts related to a module frame to those of another module frame placed side-by-side thereto.

5 Claims, 4 Drawing Sheets

(51) Int. Cl.
*E04F 17/08* (2006.01)
*E04B 1/19* (2006.01)

(52) U.S. Cl.
CPC ..... *E04F 17/08* (2013.01); *E04B 2001/1915* (2013.01); *E04B 2001/1984* (2013.01); *E04B 2001/1993* (2013.01)

(58) Field of Classification Search
USPC ..... 52/79.9, 220.2, 220.3, 220.7
See application file for complete search history.

(56) References Cited

U.S. PATENT DOCUMENTS 3,203,150 A * 8/1965 Serneblad ..... E04B 1/2403 52/664
3,462,021 A * 8/1969 Hawke ..... A47F 5/14 108/101
3,642,310 A * 2/1972 Hudson ..... F16B 7/0446 403/219
3,822,519 A * 7/1974 Antoniou ..... E04B 1/3483 52/79.13
4,125,973 A * 11/1978 Lendrihas ..... E04B 1/165 249/188
4,208,307 A 6/1980 Lutz
4,599,829 A * 7/1986 DiMartino, Sr. ..... E04B 1/3483 410/79
5,212,915 A 5/1993 Antonio
5,289,665 A * 3/1994 Higgins ..... E04B 1/2403 211/191
5,647,181 A * 7/1997 Hunts ..... A63H 33/10 312/111
6,082,070 A * 7/2000 Jen ..... E04B 1/24 403/170
6,397,551 B1 * 6/2002 Lewcock ..... E04B 2/766 52/655.1
6,405,491 B1 * 6/2002 Gallant ..... E04B 2/74 52/220.1
7,883,288 B2 * 2/2011 Jorna ..... F16B 7/0453 403/171
9,441,359 B1 * 9/2016 Hsieh ..... E04B 1/24
9,765,805 B2 * 9/2017 Pond ..... F16B 17/00
9,845,595 B2 * 12/2017 Bowron ..... F16B 7/00
10,094,104 B2 * 10/2018 Higgins ..... E04B 1/24
10,174,498 B2 * 1/2019 Winter ..... E04B 1/003
2003/0041549 A1 * 3/2003 Simmons ..... E04B 1/2403 52/655.1
2004/0226235 A1 * 11/2004 Stempinski ..... E04F 15/02411 52/220.2
2005/0241242 A1 11/2005 De La Marche
2006/0265992 A1 * 11/2006 Hiragaki ..... E04B 1/2403 52/633
2008/0178505 A1 * 7/2008 Tumlinson ..... G09F 7/18 40/607.01
2011/0016802 A1 * 1/2011 Wallance ..... E04B 1/003 52/79.9
2013/0036702 A1 * 2/2013 Pacetti ..... E04H 1/1205 52/653.2
2015/0135623 A1 5/2015 Garrett et al.
2015/0159363 A1 * 6/2015 Ehsasi ..... E04H 1/1205 52/79.5

* cited by examiner

MODULAR BUILDING STRUCTURE WITH INTEGRATED PLANTS

The present invention relates to a modular building structure with relative integrated plants, of the type obtained by assembling a plurality of module frames to obtain a complex frame therefrom a complex building is then to be implemented, and comprising walls and floors implemented by suitable panels in each module frame.

Under integrated plant any plant is meant for providing a service to the building including interconnected ducts. By way of example, one can mention heating thermal plants through radiators or integrated in the floor; conditioning plants with ducts for extracting hot and/or humid air and inletting refrigerated and/or dried air; plants for controlled mechanical ventilation; services for distributing service gas such as fuel gas, oxygen, nitrogen; plants for sucking powders and residues; plants for filtering air; electrical plants or communication plants with ducts containing electric cables, network cables, coaxial cables and so on; hot and cold network water ducts; ducts for the disposal of waste and white water; and so on.

The above-said plants, mentioned by pure way of example and not for limitative purposes, have in common the presence of ducts associated to walls of the modular building, which have to be interconnected to allow the operation of the respective plant.

U.S. Pat. No. 4,208,307 A describes a construction system with prefabricated walls, wherein some pipes are integrated inside such walls and they can be quickly connected by approaching the edges thereof.

U.S. Pat. No. 5,212,915 A describes a system for assembling fitted walls, in particular for laboratories and the like, wherein some pipes are integrated in the walls together with the supporting beams thereof.

US patent application N. 2005/241,242 A1 describes a modular building wherein the ducts of the plants are integrated in the different modules in a repetitive way.

US patent application N. 2015/135,623 A1 describes a panel for prefabricated constructions, with an inner strut assembly equipped with holes and ducts anchored to the panel through said holes.

Japanese patent application N. JP H09 328,818 A describes a building structure formed by modular frames, wherein passage sections for ducts of technical plants are provided. Other examples of structures of modular buildings are described in Japanese patent applications N. JP 2009 208,551 A and JP 2009 228,369 A.

The state of art then shows ducts of plants already integrated in panels or walls, which can be connected therebetween during the assembling of the walls themselves, but to say the truth they are not integrated with the module frame as a whole, thus by making necessary to add everything concerning a plant integrated after the construction of the complex frame of the building, by complicating the overall design and by lengthening the implementation time.

The technical problem underlying the present invention is to provide a modular building structure with relative integrated plants allowing to obviate the drawback mentioned with reference to the known art.

The solution idea consists in integrating the ducts which will provide the respective plants not to the walls but to each module frame, which could be then simply assembled with the other ones by implementing the plants with simple connections between the already arranged ducts.

Such problem is solved by a modular building structure with relative integrated plants characterizing in that:

the module frames have a substantially parallelepiped-like shape and they are identified by longitudinal, vertical and transversal beams which join at respective angles, comprising a plurality of connecting knots joining module frames adjacent at said angles, or providing for the connection of the module frames to a flat basement or a roof structure;

the adjacent beams of side-by-side module frames are spaced apart by said knots, said panels and they are connected to the beams of the module frame thereto they belong, so as to create an air gap between panels forming a wall or a floor which separates the module frames;

each knot comprises three respective crossed and through channels, arranged according to respective orthogonal axes parallel to said beams; and the integrated plants have a plurality of ducts arranged in said air gaps and in said through channels constrained to a respective module frame, which comprise, at edges or angles of the module frame, quick connections for connecting the ducts related to a module frame to those of another module frame placed side-by-side thereto.

The main advantage of the modular building structure with relative integrated plants according to the present invention lies in the fact of allowing the association of the ducts of one or more plants to the module frame and the respective walls, the plant resulting to be constructed during the assembling of the module frames by simply using the quick connections suitably arranged during design, without being the need for a repetitiveness in the arrangement of the ducts from module to module.

The present invention will be described hereinafter according to a preferred embodiment example thereof, provided by way of example and not for limitative purposes with reference to the enclosed drawings wherein.

Figure 1:
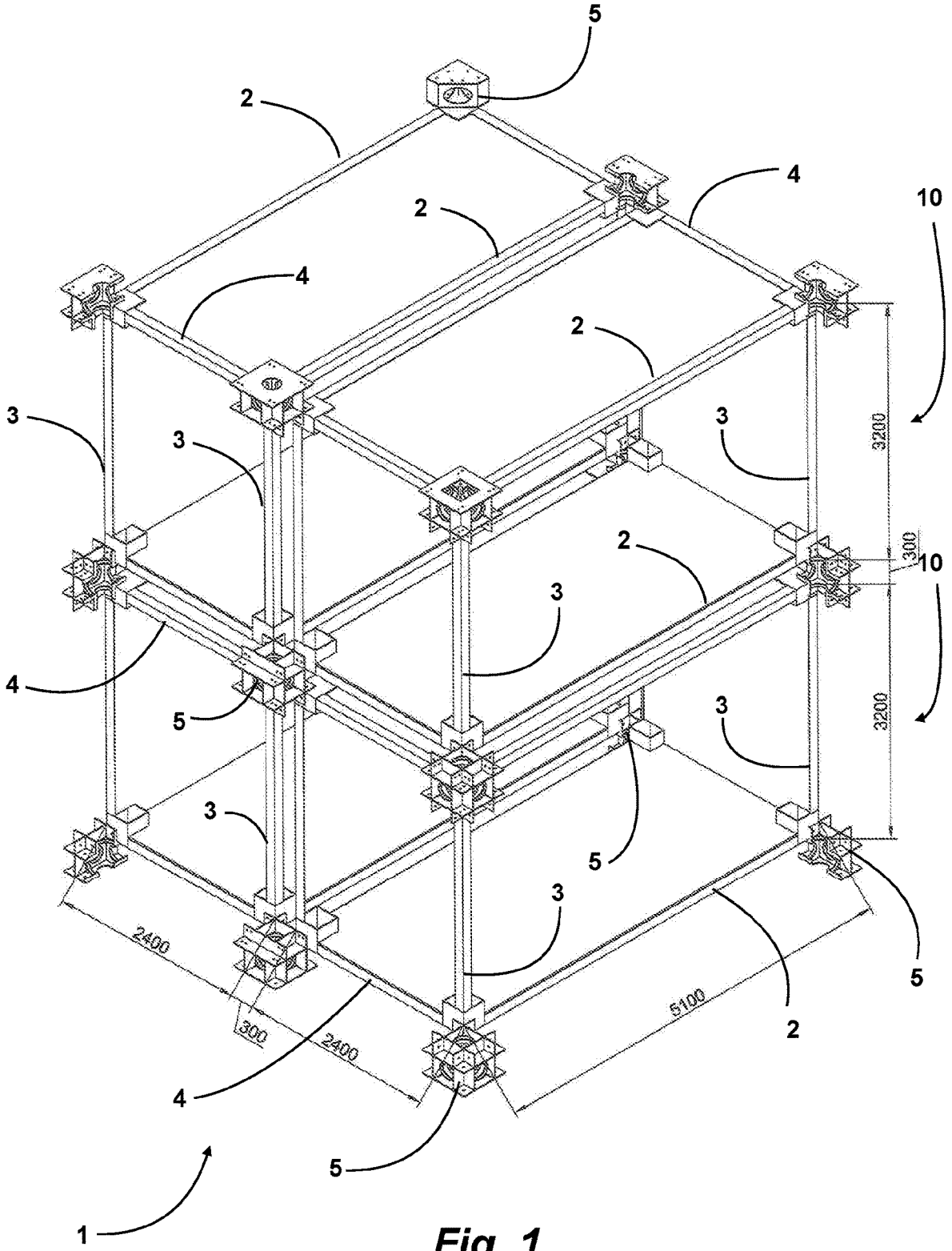
FIG. 1 shows an axonometric view of a complex frame resulting from assembling several module frames of the structure, which is suitable to receive a cladding according to the present invention, wherein the mentioned dimensions represent purely indicative and not limiting values.

By referring to FIG. 1, a complex frame of a modular building structure is designated with 1; it is constituted by a certain number of module frames 10 which have a substantially parallelepiped-like shape and they are identified by the longitudinal beams 2, the vertical beams 3 and the transversal beams 4.

Under parallelepiped, in this case a straight parallelepiped with rectangular faces is meant. Each module frame 10 has sizes allowing it to fall within the profile of a container which can be transported by ordinary route, in case loaded on the platform of an articulated vehicle, without requiring a special transportation to move it from the assembly site to the production site. A building module then will correspond to each module frame, the building module comprising the related claddings or partitions, complete with floors including ceilings and floors, which can be assembled at works, before transportation to the laying site.

Each module frame 10 then has angles wherein the longitudinal, vertical and transversal beams 2, 3, 4 join. At such angles, the complex frame 1 comprises a plurality of connecting knots 5 joining module frames 10 adjacent laterally on the same horizontal or vertical plane, the lower side or upper side on staggered planes, or providing for the connection of the module frames to a suitably arranged flat basement 80, or to a not represented roof structure.

In case of adjacent module frames 10, they could be faced at a longitudinal, vertical, upper or lower wall; otherwise, in case of frames on staggered planes, they will have in common an edge with two beams of the same type faced one onto the other one.

Therefore, the shapes of each knot 5 change according to the knot position, in particular each knot 5 should be capable of providing for the mutual connection of a number of module frame varying from one to eight and thereof with basement 80.

Generally, each knot 5 has a box-like structure with a cubic and hollow parallelepiped-like shaped inner core 6, formed by six walls faced two by two, each wall with a circular opening so that they form respective opened and through channels according to orthogonal axes X, Y and Z. Such channels are opened, and the core inner portion provides a space for passing through a channel or from a channel to the other one, by performing a sharp bend.

The core could be made of a suitable material, for example steel, preferably in one single piece and with adequate thicknesses, so as to have the required resistance to any plan stress.

Furthermore, at each opening, the core 6 comprises a corresponding supporting plate 7, for a total of six supporting plates, parallel or orthogonal therebetween two by two; in particular, the plates 7 of openings one in front of the other one are parallel therebetween, and the plates 7 of openings on adjacent plates are orthogonal therebetween.

Even the supporting plates could be made of suitable material, in case in one single piece with the core 6, or by means of welding of pieces.

Each supporting plate 7, if it extends beyond the plane defined by an adjacent plate 7, defines therewith an angular or side rest for a module frame angle.

Figure 2:
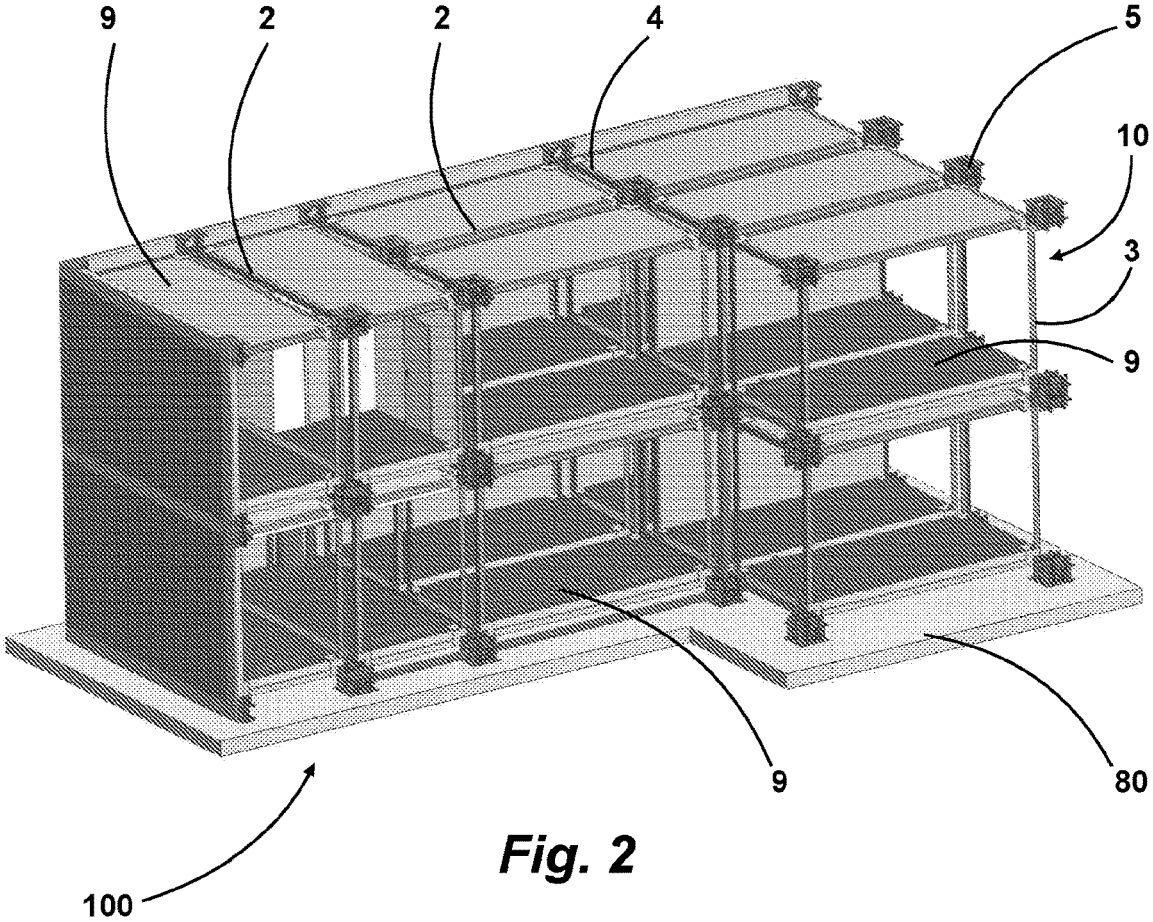
FIG. 2 shows an axonometric view of a complex building structure in partial section, obtained by means of the complex frame of FIG. 1.

By referring to FIG. 2, on an angle of the core 6 the plates 7 extend beyond the two adjacent plates and viceversa, by determining an angular rest formed by three supporting plates 7 which form an angular space with three resting walls.

Otherwise, at an angle of the core 6, two supporting plates 7 can extend one beyond the other one and viceversa, by forming a side rest formed by two L-like positioned plate ends.

In case a supporting plate 7 is not crossed by any of the adjacent plates, it forms a resting plane which can be connected to a basement or a roof.

The shape of the knots 5 then allows not only to connect adjacent module frames, but to space apart them one from the other one. This determines two substantially combined effects:

1. the overall sizes of the complex frame obtained by assembling module frames will be larger than the sum of the sizes of the single module frames; and
2. the distance between each module frame could allow, together with the presence of the above-mentioned channels in each knot 5, to arrange easily through plants of electric, water nature (mains water, white water, waste water, heating, refrigeration), air conditioning plants, service tubes, alarm plants and so on, as it will appear hereinafter in greater detail.

The first one of said effects allows to make each pre-assembled module which can be transported in a simple way, as a usual container, and then to obtain a building the overall sizes thereof would not be otherwise compatible with normal transportation systems.

To this regard, the previously described angular rests will be useful to receive the angles of each module frame. Each angle will include a box-like connecting element 8, formed by two or three walls connected therebetween, which will be in contact with the respective rest.

Advantageously, the frame beams have a L-like section with the inner angle facing towards the inner space of the module frame, to provide a support to the edges of the inner panels 9.

The L-like beams, as well as the connecting elements 8, could be made of suitable material, for example a folded or forged steel plate, or obtained by welding.

Each module, although formed by a frame which repeats module by module, could assume very different shapes, but it will include, at the walls forming the outer surface of a complex building, outer claddings which can be adapted to the climatic area of interest.

Figure 1A:
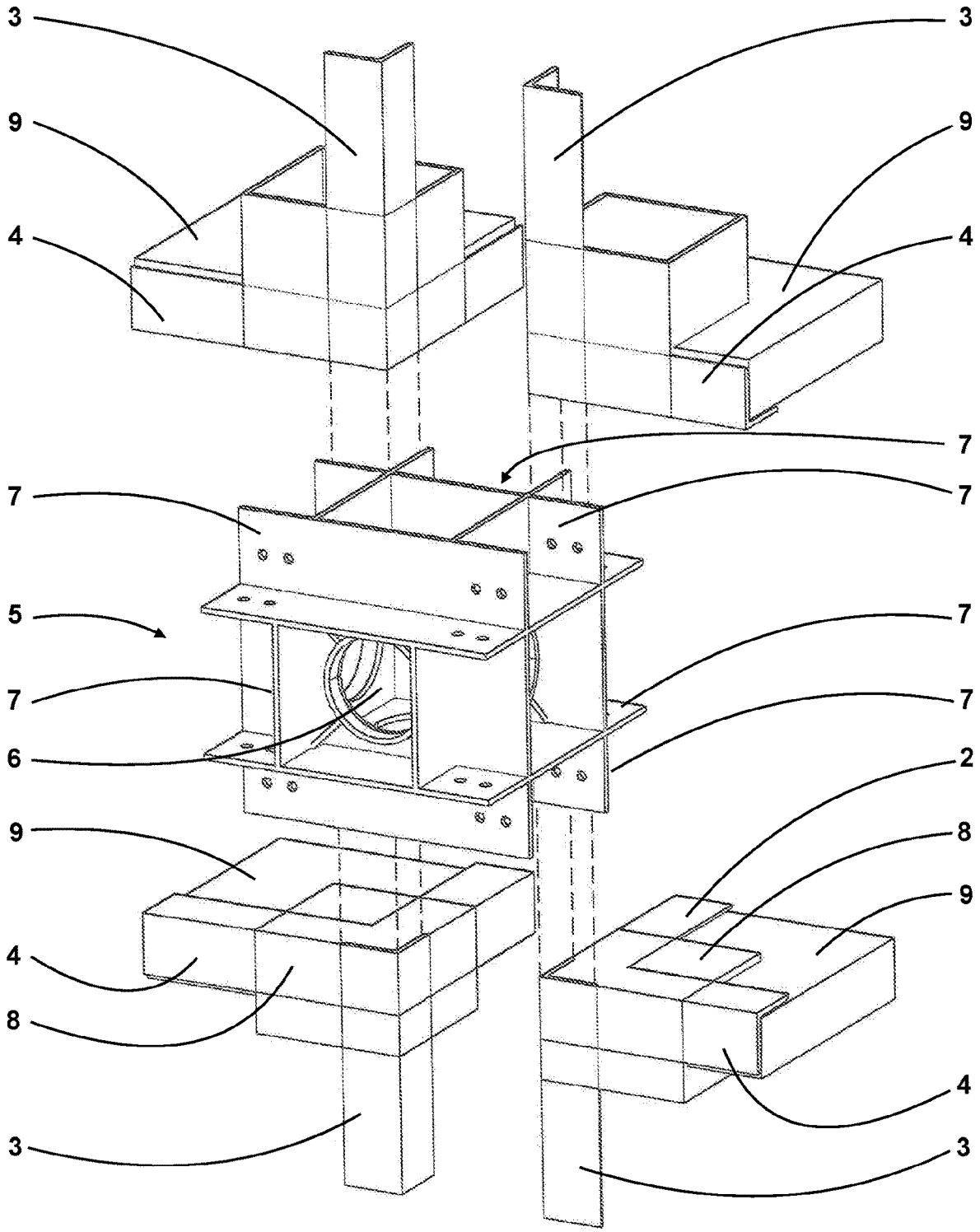
FIG. 1A shows a detail of a module frame of FIG. 1, with an exploded view illustrating the scheme for assembling a cladding according to the present invention.

As it can be noted (FIG. 1A), there are panels 9 forming the walls of the structure of a building. Each panel 9 is inserted inside each L-like beam thereto it is connected or rested, and it forms a wall on itself or together with the panel 9 fastened to the adjacent beams.

In other words, the adjacent beams of side-by-side module frames are spaced apart by knots 5, and the panels 9 which are connected to the beams of the module frame 10 thereto they belong form an air gap between panels forming a wall; the same thing is valid for the floors too, which show a ceiling and a floor placed side-by-side but separated and spaced apart by an air gap, for the space between the ceiling of the highest floor and the roof structure and for the space between the panel of the lowest floor and the basement 80.

Figure 5:
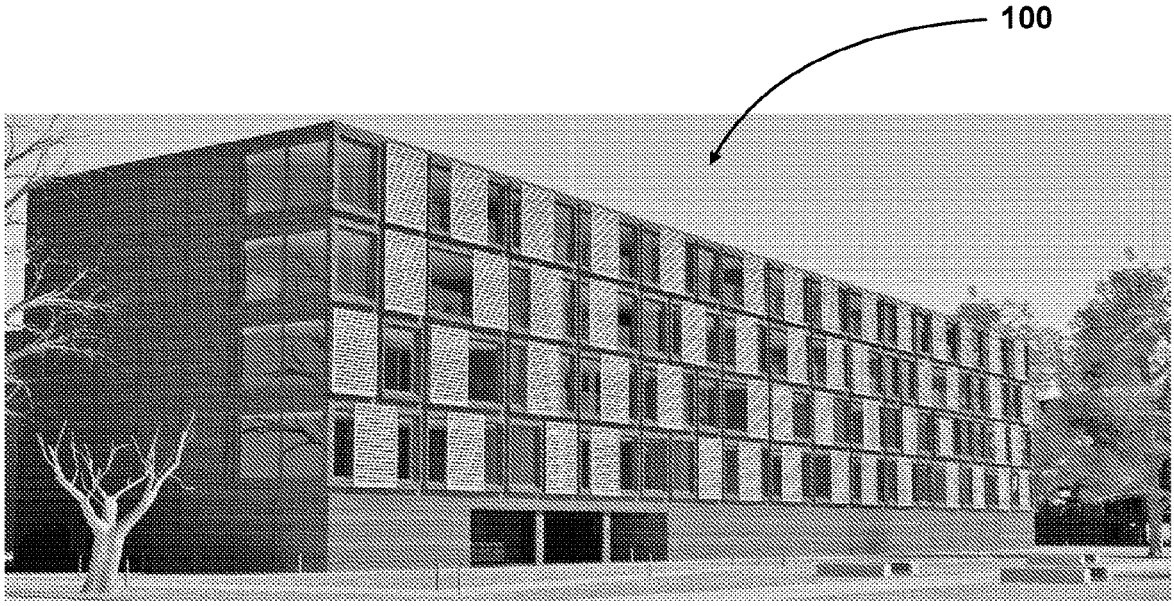
FIG. 5 shows a perspective view of the complex building complete with finishings.

From what described above, the spaces offered by the above-mentioned air gaps and by the channels integrated in the knots 5 offer the possibility of arranging ducts of any nature therein, by constraining the same ducts, during design, not only to the respective walls, or that is to the respective panels, but to the module frames or to the modules which are designed to form the building structure 100 (FIG. 5).

In order to implement the connections between the ducts related to a module and the ducts linked to another adjacent one, in the integrated plants they have a plurality of ducts arranged in said air gaps and in said through channels, which comprise, at edges or angles of the module frame, quick connections to connect the ducts related to a module frame to those related to another module frame placed side-by-side thereto.

Figure 3:
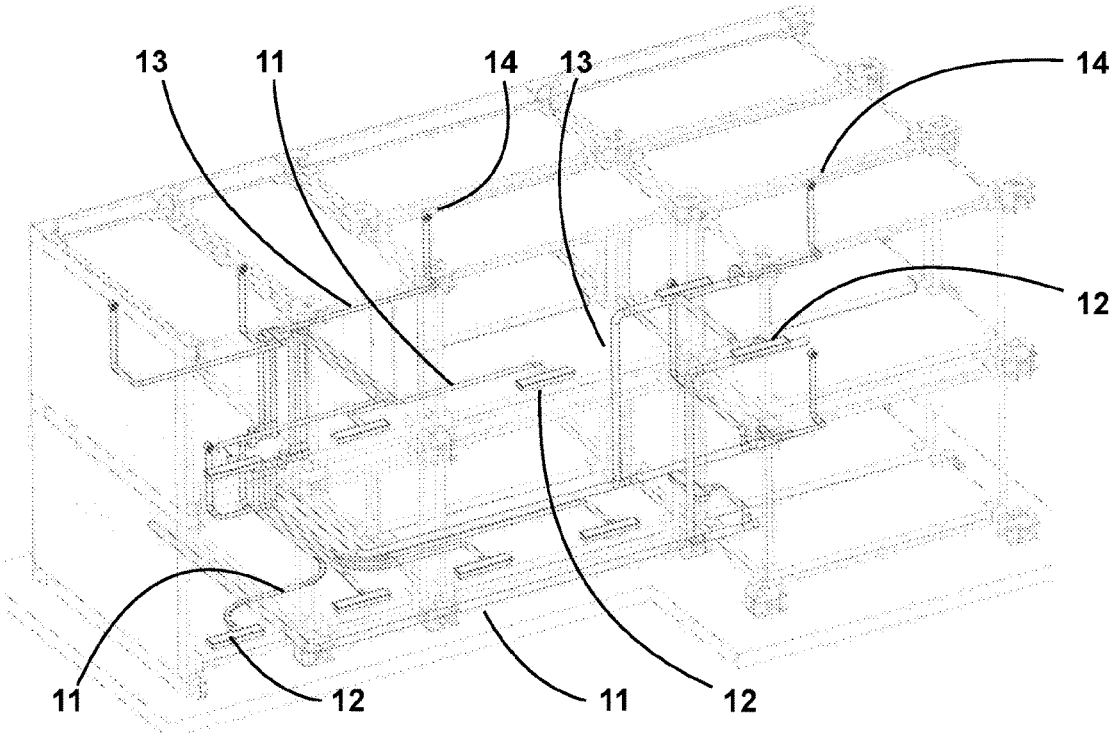
FIGS. 3 and 4 show respective axonometric views of the plant of the building of FIG. 2, illustrated in semi-transparency.
Figure 4:
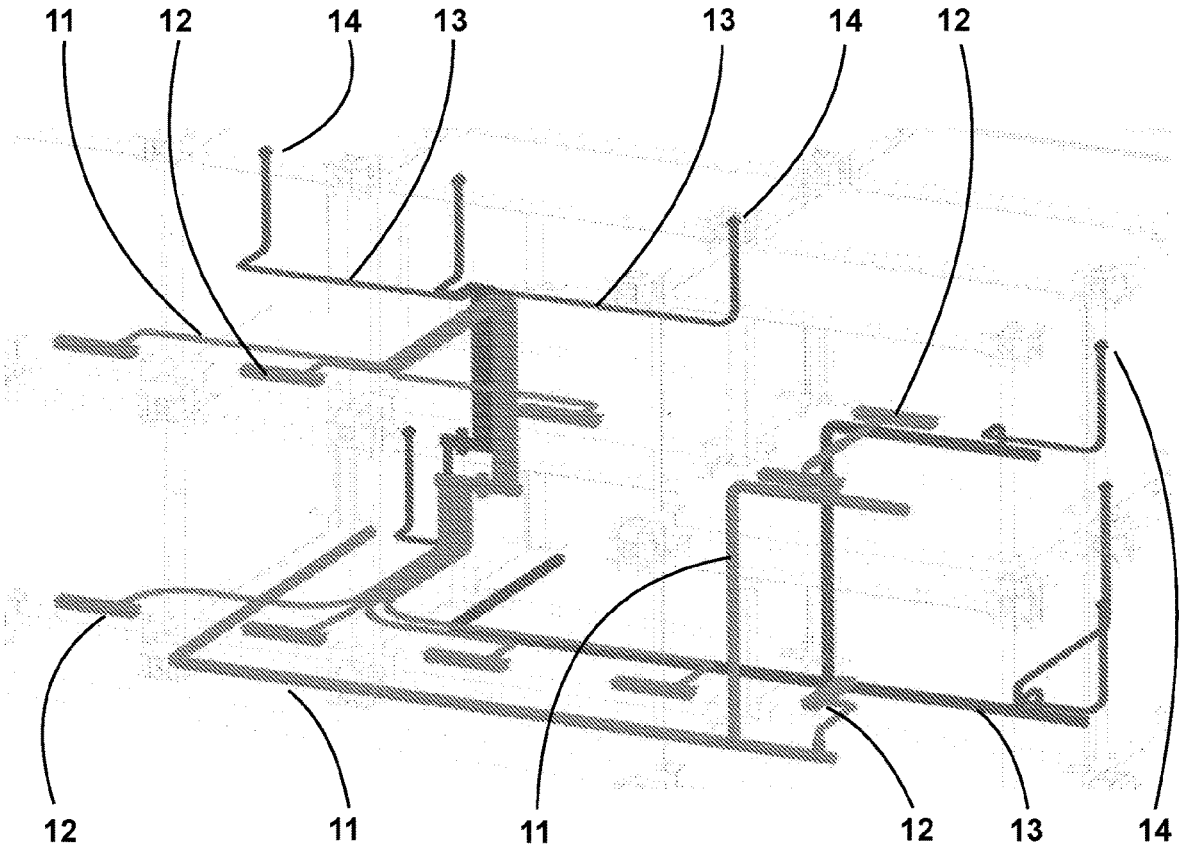

By referring to FIGS. 3 and 4, a water heating system is represented by way of example, including first ducts 11 and radiators 12: it is noted that, by passing from a module to another adjacent one, the plant has said plurality of connections comprising sharp connections, at the knots 5, linear connections or even T-like connections or even more complex ones.

Moreover, there is a conditioning plant with second ducts 13 which transport air as far as nozzles 14. Again, this plant has a respective plurality of connections which comprises sharp connections, at the knots 5, linear connections or even T-like connections or more complex ones.

It is easily understood that these schemes can be substantially repeated for any type of plant with ducts.

The above-described components will be treated in order to have fireproofing, anti-intumescent features, and to be protected from corrosion.

To the above-described modular building structure with relative integrated plants a person skilled in the art, in order to satisfy additional and contingent needs, could introduce several additional modifications and variants, all however comprised within the protection scope of the present invention, as defined by the enclosed claims.

The invention claimed is:

1. A modular building structure with related integrated plants, including ducts, the modular building structure having a complex frame obtained by assembling a plurality of module frames, and including walls and floors implemented by panels in each module frame, wherein:

the module frames have a substantially parallelepiped-like shape and are identified by longitudinal, vertical and transversal beams joining at respective corners, comprising a plurality of connecting knots joining module frames adjacent at said corners, and provided to connect the module frames either to a flat basement or to a roof structure;

the adjacent beams of side-by-side module frames and the respective panels, which are fastened to said longitudinal, vertical and transversal beams in each module frame, are both spaced apart by said connecting knots, so as to create an air gap between adjacent panels of adjacent module frames, forming a wall or a floor separating the module frames;

each connecting knot comprises three respective crossed and pass-through channels, arranged according to respective orthogonal axes parallel to said beams; and the ducts of said integrated plants are arranged in said air gaps between adjacent panels and in said pass-through channels and constrained to a respective module frame, comprising, at edges and or at corners of the module frame, quick connections for connecting ducts related to a module frame to ducts of another module frame placed side-by-side thereto.

2. The modular building structure with related integrated plants according to claim 1, wherein the beams have an L-shaped section with a concavity portion of the L-shape facing inside the respective module frame, the panels being constrained to said beams resting inside said beams.

3. The modular building structure with related integrated plants according to claim 2, wherein an corner rest is provided forming an angular space with three resting walls for a panel corner, each corner rest comprising a box-like connecting element, formed by two or three walls connected therebetween, in contact with the walls of the corner rest.

4. The modular building structure with related integrated plants according to claim 1, wherein each connecting knot has a box-like structure with a hollow parallelepiped shaped inner core having six walls faced two by two and defining planes orthogonal to each other, each wall having an opening so that the openings form together said three pass-through orthogonal channels, and wherein, at each opening, the connecting knot comprises corresponding supporting plates, each lying on a respective plane extending beyond a plane identified by one or more walls, thereby defining a respective corner or side rest for said longitudinal, vertical and transversal beams.

5. The modular building structure with related integrated plants according to claim 1, wherein the module frames have a straight parallelepiped shape with rectangular faces, and sized to comply with standard container sizes.

* * * * *